US008069795B1

(12) United States Patent
Williams et al.

(10) Patent No.: US 8,069,795 B1
(45) Date of Patent: Dec. 6, 2011

(54) GRIP LATCH AND HINGE MECHANISM FOR A FLIP TABLE

(75) Inventors: Scott J. Williams, Green Bay, WI (US); James M. Durand, DePere, WI (US); John K. Blomstrom, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 280 days.

(21) Appl. No.: 12/482,602

(22) Filed: Jun. 11, 2009

(51) Int. Cl.
*A47B 3/00* (2006.01)

(52) U.S. Cl. ..... 108/115; 108/132; 248/188.6

(58) Field of Classification Search ..... 108/115, 108/132, 118, 6, 7, 9, 124, 123, 128, 131, 108/133; 248/371, 166, 188.6, 434, 439, 248/188.1, 188.7
See application file for complete search history.

(56) References Cited

U.S. PATENT DOCUMENTS

| | | | | |
|---|---|---|---|---|
| 1,120,702 | A * | 12/1914 | Erdman | 108/115 |
| 3,401,653 | A | 9/1968 | Knoblock | |
| 3,561,376 | A | 2/1971 | Knoblock | |
| 3,796,169 | A | 3/1974 | Bales et al. | |
| 4,196,675 | A | 4/1980 | Cook | |
| 4,879,954 | A | 11/1989 | Sawamura et al. | |
| 4,955,294 | A | 9/1990 | Abe | |
| 4,986,195 | A | 1/1991 | Diffrient | |
| 5,205,223 | A | 4/1993 | Ball et al. | |
| 5,337,657 | A | 8/1994 | Diffrient | |
| 5,417,168 | A | 5/1995 | Soper | |
| 5,573,590 | A | 11/1996 | Soper | |
| 5,603,267 | A | 2/1997 | Soper | |
| 5,927,214 | A | 7/1999 | Schwartz et al. | |
| 6,164,217 | A | 12/2000 | Prendergast | |
| 6,192,808 | B1 | 2/2001 | Bue | |
| 6,257,153 | B1 * | 7/2001 | Portugal | 108/115 |
| 6,336,414 | B1 | 1/2002 | Stewart et al. | |
| 6,637,352 | B1 | 10/2003 | Thode et al. | |
| 6,662,731 | B2 | 12/2003 | Teppo et al. | |
| 6,845,723 | B2 * | 1/2005 | Kottman et al. | 108/115 |
| 6,845,732 | B2 | 1/2005 | Lim | |
| 7,066,098 | B2 | 6/2006 | Blasen et al. | |
| 7,614,351 | B2 * | 11/2009 | Piretti | 108/115 |
| 7,631,604 | B2 * | 12/2009 | Huang | 108/115 |
| 7,703,400 | B2 * | 4/2010 | Mockel | 108/115 |
| 7,712,422 | B2 * | 5/2010 | Bue | 108/115 |
| 7,765,938 | B2 * | 8/2010 | Piretti | 108/115 |
| 7,836,833 | B2 * | 11/2010 | Kumazawa | 108/115 |
| 7,845,290 | B2 * | 12/2010 | Piretti | 108/115 |
| 2005/0274301 | A1 | 12/2005 | Rattin et al. | |
| 2008/0250988 | A1 | 10/2008 | Merey | |
| 2008/0295742 | A1 * | 12/2008 | Henriott | 108/115 |
| 2009/0283020 | A1 * | 11/2009 | Hsu | 108/115 |

* cited by examiner

*Primary Examiner* — Jose V Chen
(74) *Attorney, Agent, or Firm* — Andrus, Sceales, Starke & Sawall, LLP

(57) ABSTRACT

A flip-type nesting table includes a frame, a tabletop that pivots between an operative position and a storage position and a hinge and latch assembly that controls the movement of the tabletop between the operative position and the storage position. The hinge and latch assembly includes a pair of hinge brackets that each mount to a rear cross-member. Each hinge bracket includes a front latch that engages a front cross-member to hold the tabletop in the operative position. A rear latch is operable to engage the rear cross-member to hold the tabletop in its upright, storage position. The hinge and latch assembly includes a pull handle coupled to a cross bar that can be used to simultaneously move the latch members to allow movement of the tabletop between the usage position and the storage position.

26 Claims, 8 Drawing Sheets

20
46
18
62
36
48
50
40
38
70
44
64
66
9
12
14
42
32
16,17
68
54
72

GRIP LATCH AND HINGE MECHANISM FOR A FLIP TABLE

BACKGROUND OF THE INVENTION

The present disclosure generally relates to a flip-type nesting table. More specifically, the present disclosure relates to a flip-type nesting table that includes a hinge and latch assembly that control the movement of the tabletop between an operative position and a storage position.

Modern office, institutional and educational environments often operate in limited spaces. Since the available space must be used for different purposes, the space must be convertible to accommodate the variety of functions to be carried out in the space. To accommodate the variety of function to be carried out in the common space, the furniture used in these spaces must have the ability to be flexible and adapt the available indoor/outdoor space to the needs of the institution. Presently, many different types of furniture are available that allow the user to adapt the furniture to the specific need for the available space. In addition to being adjustable depending upon the needs of the space, it is also desirable that furniture be readily storable when not needed.

One type of furniture that is particularly desirable is a table that can be moved between an operative position and a storage position such that when the table is in the storage position, tables can be nested to reduce the amount of space required to store the tables. Although this type of table is currently available, drawbacks exist in the ability to nest the tables in a closely arranged stack. Further, the mechanism required to move the tabletop from the operative position to the storage position can be difficult to use and expensive to manufacture.

SUMMARY OF THE INVENTION

The present disclosure generally relates to a flip-type nesting table that includes a table top that is movable between a generally horizontal, operative position and a generally vertical, storage position. When the table top is in the storage position, multiple flip tables can be nested together to reduce the amount of space required for storage.

The flip table assembly includes a pair of spaced side supports that are each operable to support the flip table on a support surface. The pair of spaced side supports each include a front leg and a rear leg that extends upward from a ground engaging end. In one embodiment of the disclosure, the distance between the ground engaging end of the spaced front legs is less than the distance between the ground engaging ends of the spaced rear legs. The reduced distance between the front legs allows multiple flip tables to be nested together for storage.

The front legs of the flip table assembly are joined to each other by a front cross member while the rear legs of the flip table assembly are joined to each other by a rear cross member. The front and rear cross members are spaced from each other. In one embodiment, both the front and rear legs include a pair of latching collars positioned between the front and rear legs and the respective front and rear cross members.

A hinge and latch assembly is pivotally mounted to the rear cross member and coupled to an under surface of the table top. The hinge and latch assembly allows the table top to pivot about the rear cross member and move between the generally horizontal operative position and the generally vertical storage position. In one embodiment of the disclosure, the hinge and latch assembly is movable between a first position and a second position and can be locked into both of the first and second positions. When the hinge and latch assembly is in the first position, the table top is in the generally vertical storage position. When the hinge and latch assembly is in the second position, the table top is in the generally horizontal, operative position.

The hinge and latch assembly includes a pair of spaced hinge brackets that are each pivotally mounted to the rear cross member. The first and second hinge brackets are coupled to each other by a cross bar that includes a pull handle.

The cross bar joining the first and second hinge brackets is coupled to a latch member received in each of the first and second hinge brackets. Each latch member includes a front latch and a rear latch, where the front latch engages the front cross member to retain the hinge and latch assembly in the second position and the rear latch engages the rear cross member to retain the hinge and latch assembly in the first position. Each of the latch members is biased into a latching position to retain the hinge and latch assembly in either the first position or the second position.

The front and rear latches can be released by exerting force on the pull handle to move the latch members away from the biased position. The cross member is operable to simultaneously release both the front and rear latches.

The hinge and latch assembly of the disclosure selectively locks the table top in either the horizontal, operative position or the vertical, storage position, as desired. The hinge and latch assembly can be released by activation of the pull handle to allow ease of movement between the storage position and the operative position.

Various other features, objects and advantages of the invention will be made apparent from the following description taken together with the drawings.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
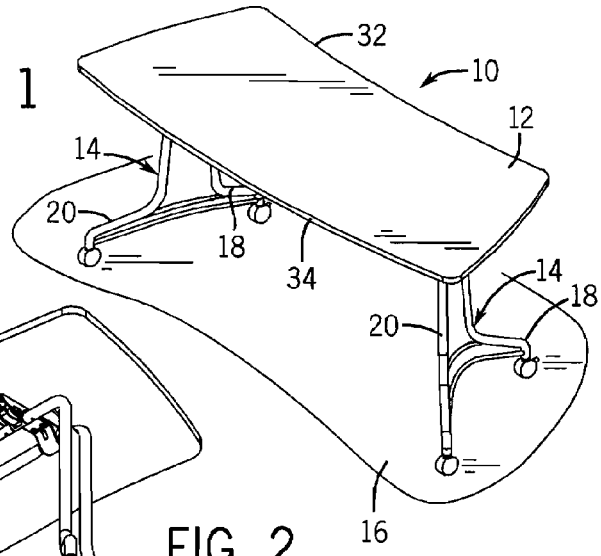
FIG. 1 is a top perspective view of a flip table constructed in accordance with the present disclosure.

FIG. 1 illustrates a flip table 10 constructed in accordance with the present disclosure. The flip table 10 includes a tabletop 12 supported by a pair of spaced side supports 14. The side supports 14 space the tabletop 12 above a support surface 16, such as the floor. In the embodiment illustrated in FIG. 1, each of the side supports 14 includes a front leg 18 and a rear leg 20.

Figure 2:
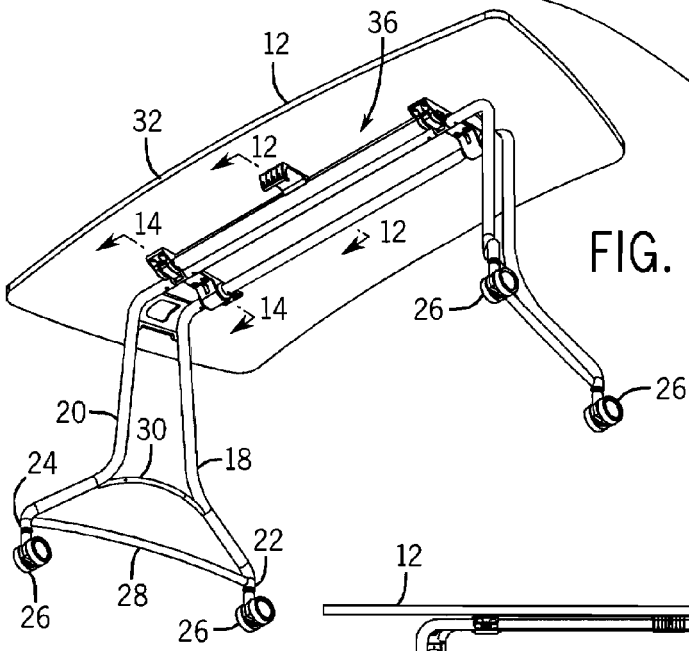
FIG. 2 is a bottom perspective view illustrating the latch and hinge mechanism constructed in accordance with the present disclosure.

As can be seen in FIG. 2, both the front leg 18 and the rear leg 20 are tubular members that terminate at a ground engaging end 22, 24. The ground engaging ends 22, 24 of each of the front and rear legs 18, 20 receive a caster wheel 26. In the embodiment shown in FIG. 2, a lower brace 28 and an upper brace 30 provide structural stability between the front leg 18 and the rear leg 20.

Referring again to FIG. 1, the tabletop 12 extends between a front edge surface 32 and a rear edge surface 34. Although a specific configuration is shown for the tabletop 12 in FIG. 1, it should be understood that various different configurations for the tabletop 12 are contemplated as being within the scope of the present disclosure.

Figure 3:
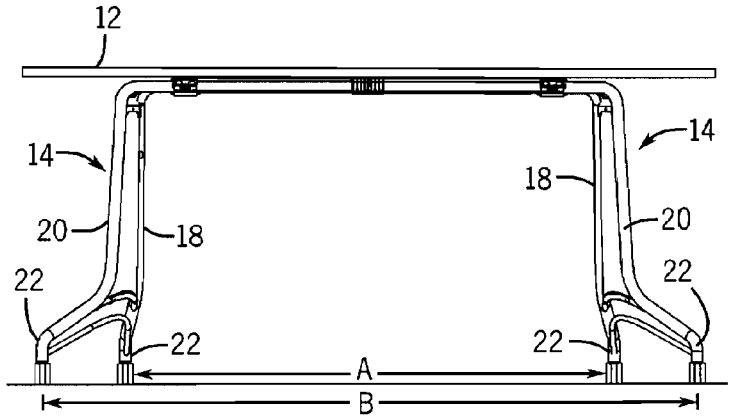
FIG. 3 is a front view of the flip table including the latch and hinge mechanism.
Figure 4:
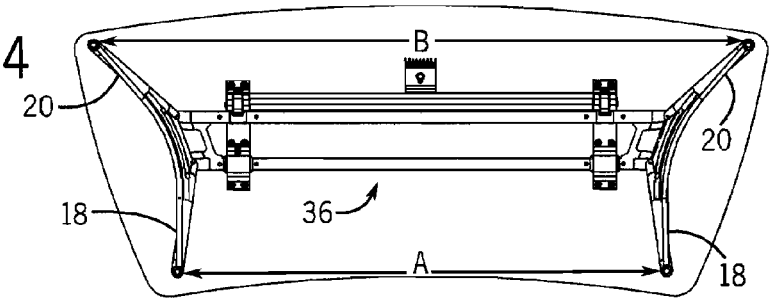
FIG. 4 is a bottom elevation view of the flip table illustrating the latch and hinge mechanism.
Figures 5, 6, 8, 9:
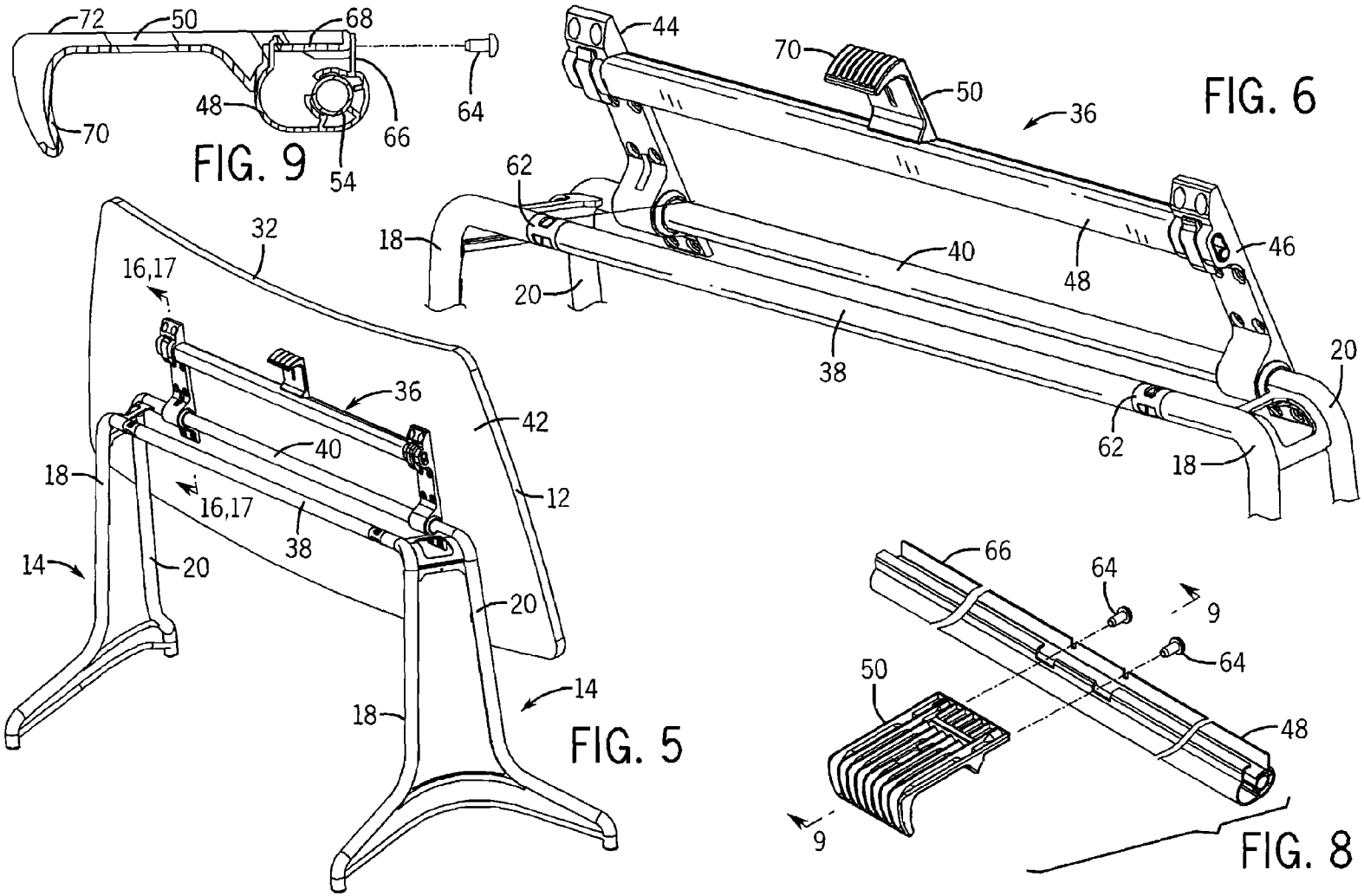
FIG. 5 is a perspective view illustrating the flip table with the tabletop in the storage position.
FIG. 6 is a perspective view of the latch and hinge mechanism of the present disclosure.
FIG. 8 is an exploded view illustrating the attachment of the pull handle to the cross bar of the latch and hinge mechanism.
FIG. 9 is a section view taken along line 9-9 of FIG. 8 illustrating the attachment of the pull handle to the cross bar.

In FIGS. 1-3, the tabletop 12 is shown in its usage position. In this position, the tabletop 12 is generally horizontal and parallel to the support surface 16. The flip table 10 includes a hinge and latch assembly 36 (FIG. 2) that allows the tabletop 12 to pivot from the operative position shown in FIG. 2 to a storage position, as best shown in FIG. 5. When the tabletop 12 is in the storage position shown in FIG. 5, the flip tables 10 can be nested to reduce the amount of storage space required for storing the multiple flip tables 10. The hinge and latch assembly 36 allows the tabletop 12 to pivot between the horizontal, operative position shown in FIG. 2 and the generally vertical, storage position shown in FIG. 5.

Figure 18:
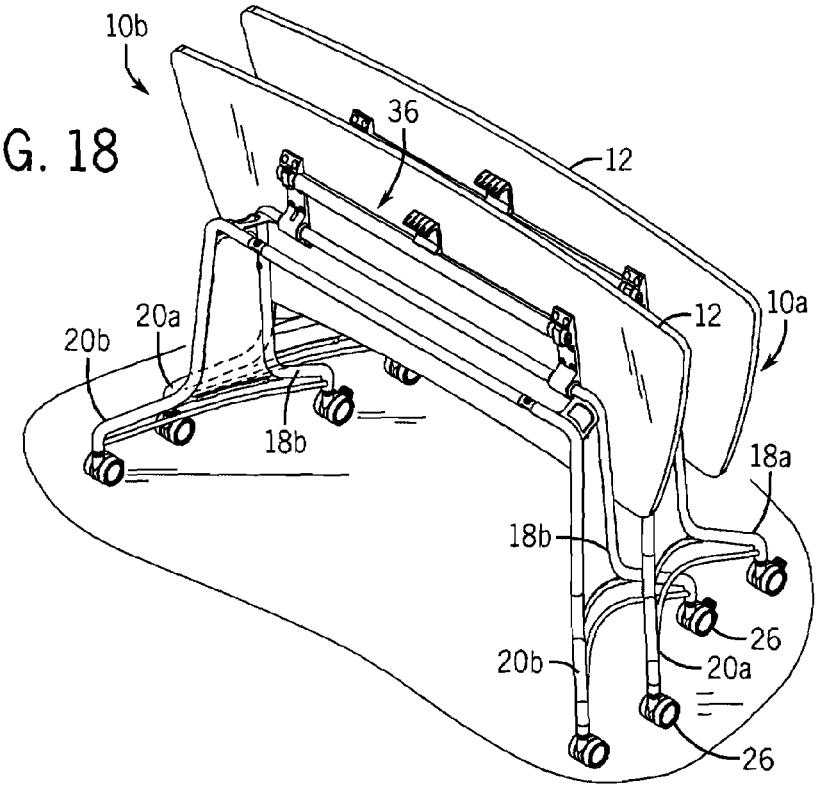
FIG. 18 is a perspective view illustrating the nesting of two flip tables in the storage condition.
Figure 19:
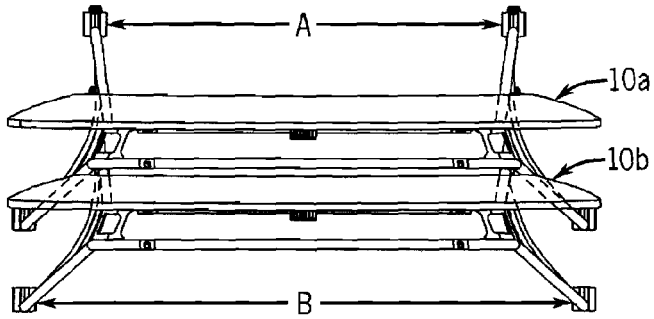
FIG. 19 is a top view of the pair of flip tables.
Figure 20:
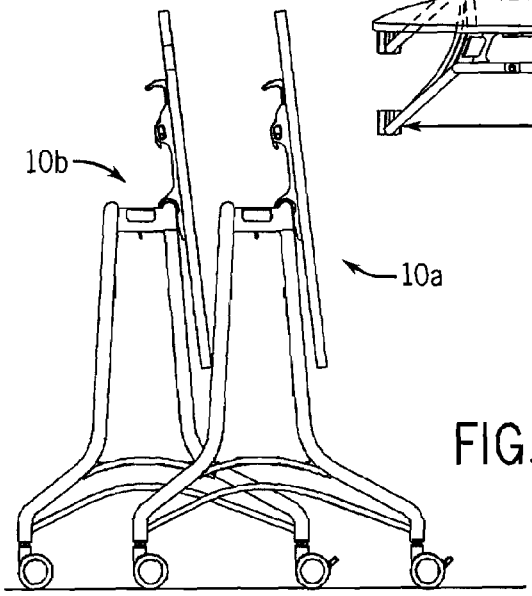
FIG. 20 is a side view of the flip table in the nested condition.

Referring now to FIG. 3, the side supports 14 are each configured such that the distance A between the ground engaging end 22 of the front legs 18 is substantially less than the distance B between the ground engaging ends 22 of the rear legs 20. As can be clearly understood in FIG. 18, when a rear table 10*b* is pushed adjacent a front table 10*a*, the caster wheels 26 contained on the front legs 18*b* of the rear table 10*b* pass inside the caster wheels 26 contained on the rear legs 20*a* of the front table 10*a*. As can be seen in FIGS. 19 and 20, the configuration of the side supports 14 allow the flip tables 10*a* and 10*b* to nest within each other to reduce the amount of storage space required to store multiple tables.

Although the embodiment of the flip table 10 is shown with the front and rear legs 18, 20 spaced different distance to accommodate nesting in the storage position, it should be understood that the front and rear legs 18, 20 could be equally spaced while operating within the scope of the present disclosure. In such a configuration, the flip tables 10*a* and 10*b* could be stored in an offset condition to reduce the amount of space required to store the tables.

As illustrated in FIG. 5, the pair of spaced side supports 14 are joined to each other by a front cross-member 38 and a rear cross-member 40. In the embodiment illustrated in FIG. 5, both the front cross member 38 and the rear cross member 40 are tubular members that extend between the side supports 14. Specifically, the front cross-member 38 extends between the front legs 18 while the rear cross-member 40 extends between the rear legs 20 of the spaced side supports 14. As illustrated in FIG. 5, the hinge and latch assembly 36 is mounted to the underside 42 of the tabletop 12 and is pivotally mounted to on and about the rear cross-member 40.

Figure 7:
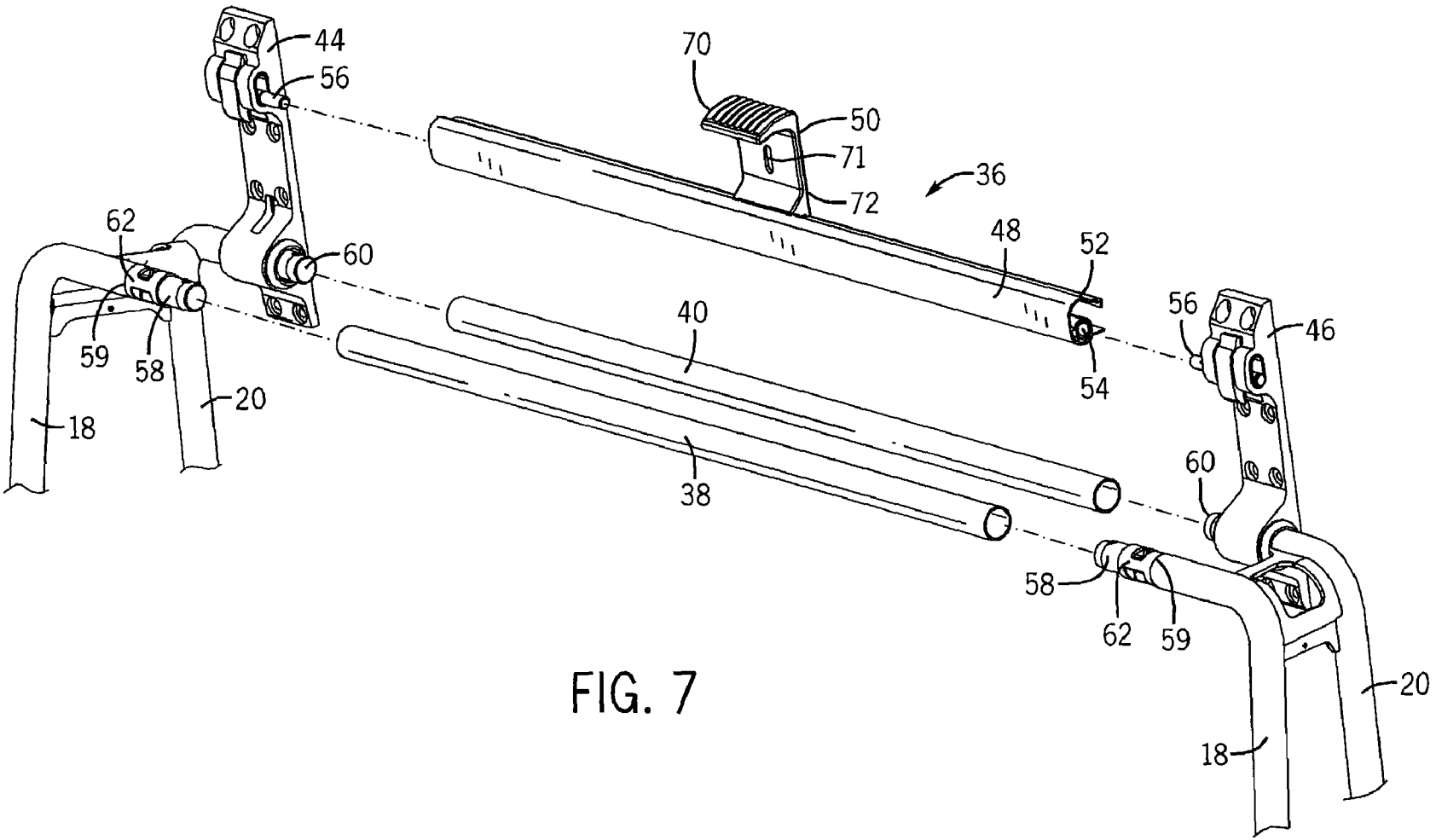
FIG. 7 is an exploded view of the latch and hinge mechanism.

FIGS. 6 and 7 provide a more detailed view of the hinge and latch assembly 36 of the present disclosure. The hinge and latch assembly 36 generally includes a first hinge bracket 44 and a second hinge bracket 46 joined to each other by a cross bar 48. The combination of the first and second hinge brackets 44, 46 and the cross bar 48 combine to form the U-shape hinge and latch assembly 36. The cross bar 48 receives a pull handle 50 which provides a convenient point of engagement for a user of the flip table.

As illustrated in FIG. 7, the cross bar 48 includes an outer, vinyl wall 52 having the required strength to join the pair of spaced first and second hinge brackets 44, 46. The cross bar 48 includes a receiving tube 54 that extends along the length of the cross bar 48 and receives a latch pin 56 included in each of the first and second hinge brackets 44, 46.

As illustrated in FIG. 7, the front cross-member 38 is received on an attachment end 58 of a latching collar 62 received in the outer end 59 of each of the front legs 18. Likewise, the rear cross-member 40 is received on an attachment end 60 of a similar latching collar 62 received in the outer end 61 of each of the rear legs 20 (see FIG. 10). Both of the front legs 18 receive one of the latching collars 62. The latching collars 62 connected to the front legs 18 each provide a point of latching engagement for the first and second hinge brackets 44, 46 as will be described in greater detail below.

Referring now to FIGS. 8 and 9, the pull handle 50 is formed as a plastic molded component that is securely attached to the vinyl cross bar 48 by a pair of connectors 64. As illustrated in FIG. 9, the connectors 64 pass through a back wall 66 of the cross bar 48 and are received within an attachment portion 68 of the pull handle 50. The connectors 64 can be any type of connector that is able to hold the pull handle 50 within the cross bar 48.

Figure 12:
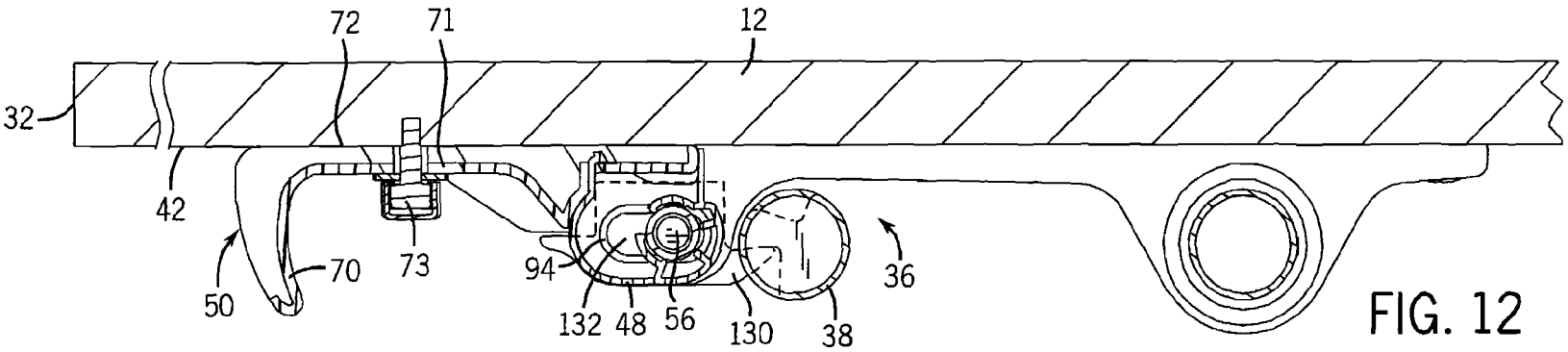
FIG. 12 is a section view taken along line 12-12 of FIG. 2.

The pull handle 50 includes a gripping section 70 that extends away from the back wall 72. As can be understood in FIG. 5, the back wall of the pull handles 50 is generally positioned adjacent to the underside 42 of the tabletop 12. In this manner, the gripping section 70 provides for a convenient area for a user to grasp when utilizing the flip table 10 of the present disclosure. As illustrated in FIG. 7, the pull handle 50 includes a slot 71 formed in the back wall 72. As illustrated in FIG. 12, the slot 71 receives a connector 73 that retains the back wall 72 of the pull handle against the underside 42 of the table top 12 while allowing lateral movement of the pull handle 50.

Figure 10:
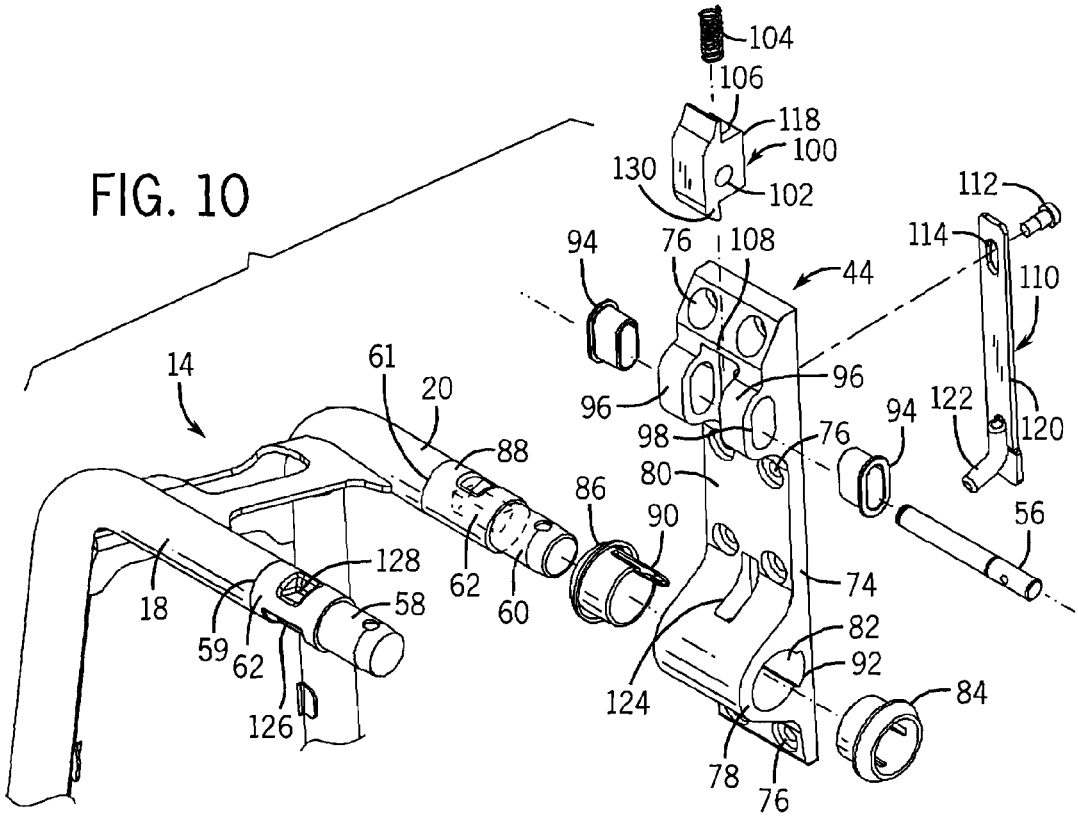
FIG. 10 is an exploded perspective view illustrating the configuration of one of the hinge brackets.

FIG. 10 illustrates the configuration of the first hinge bracket 44. Although only the first hinge bracket 44 is shown in FIG. 10, it should be understood that the second hinge bracket 46 (not shown) is constructed in a similar manner as the first hinge bracket 44 shown in FIG. 10. The first hinge bracket 44 includes a body 74 preferably formed from a single piece of metallic material. The body 74 includes a plurality of attachment openings 76 each configured to receive a connector to securely attach the body 74 to the undersurface of the tabletop.

Figure 11:
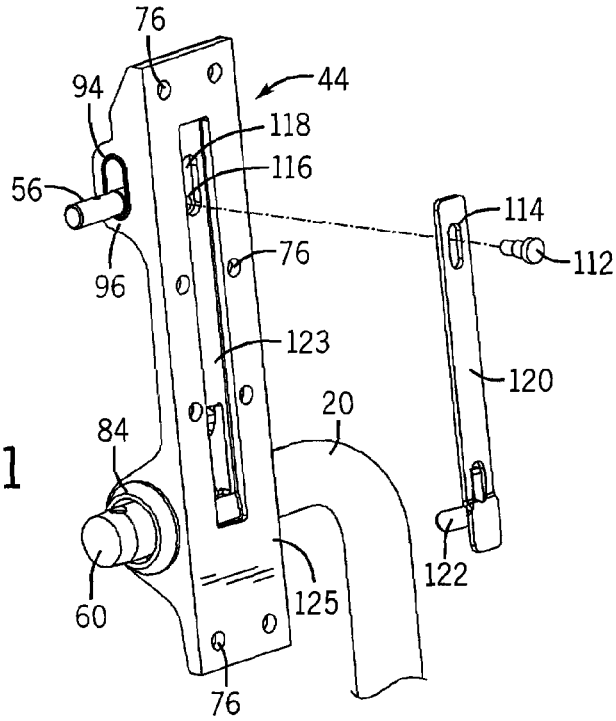
FIG. 11 is a rear perspective view illustrating the configuration of the hinge bracket shown in FIG. 10.

The first hinge bracket 44 includes a hinge barrel 78 that protrudes from the otherwise generally planar back wall 80. The hinge barrel 78 includes an axial bore 82 sized to receive the latching collar 62 received on the rear leg 20 of the side support 14. In the embodiment illustrated in FIG. 10, the bore 82 receives an inner bushing 84 and an outer bushing 86. The outer bushing 86 is configured to slide over the attachment end 60 of the latching collar 62 and rotate about the outer surface 88 of the latching collar 62. A key 90 formed on the outer bushing 86 is received within a keyway 92 to prevent relative rotation between the first hinge bracket 44 and the outer bushing 86. Both the outer bushing 86 and the inner bushing 84 are sized such that the bushings 84, 86 are rotatable about the outer surface 88. As illustrated in FIG. 11, when the first hinge bracket 44 is installed, the attachment end 60 of the latching collar 62 extends past the inner bushing 84. As discussed previously, the attachment end 60 receives the rear cross-member 40, as shown and described in FIG. 7.

Referring back to FIG. 10, the first hinge bracket 44 receives a pair of latch pin bushings 94. The latch pin bushings 94 are each received within an opening 98 formed in one of pair of latch pin mounting sections 96 formed as part of the first hinge bracket 44. The latch pin 56 passes through the pair of bushings 94 and the openings 98 formed in the latch pin mounting sections 96.

The first hinge bracket 44 further includes a sliding front latch 100. The sliding front latch 100 includes an opening 102 that receives the latch pin 56 to securely to hold the sliding front latch 100 between the pair of spaced latch pin mounting sections 96. A latch spring 104 is positioned between a back wall 106 of the sliding front latch 100 and a cavity end wall 108. The latch spring 104 provides a bias force to urge the sliding front latch 100 away from the end wall 108 and into a latched condition.

The sliding front latch 100 forms part of a latch member 110 that includes a main body 120. The front latch 100 is connected to the latch member 110 by a connector 112 that passes through an opening 114 formed in the body 120. As illustrated in FIG. 11, the connector 112 is received within an attachment hole 116 formed on the back surface 118 of the sliding front latch 100. Latch member 110 includes a generally planar extended body 120 that further includes a rear latch 122. The rear latch 122 extends into an access slot 124 formed in the hinge barrel 78, as illustrated in FIG. 10. As illustrated in FIG. 11, the main body 120 is received within an open cavity recessed from the back surface 125 of the first hinge bracket 44. When the first hinge bracket 44 is mounted to the underside of the table top, the main body 120 of the latch member 110 is entrapped between the hinge bracket 44 and the underside of the table top.

Referring back to FIG. 10, the front leg 18 includes the latching collar 62 as previously described. The latching collar 62 includes a lower engagement shoulder 126 and an upper engagement shoulder 128. The lower engagement shoulder 126 is sized to receive a latching finger 130 formed as part of the sliding front latch 100. The upper engagement surface 128 is included on the latching collar 62 such that the latching collar 62 can be used on either side of the flip table 10 or on either the front leg 18 or the rear leg 20.

The operation of the hinge and latch assembly 36 to allow movement of the tabletop from the storage position shown in FIG. 5 to the operative position of FIGS. 2 and 3 will be described.

Figure 14:
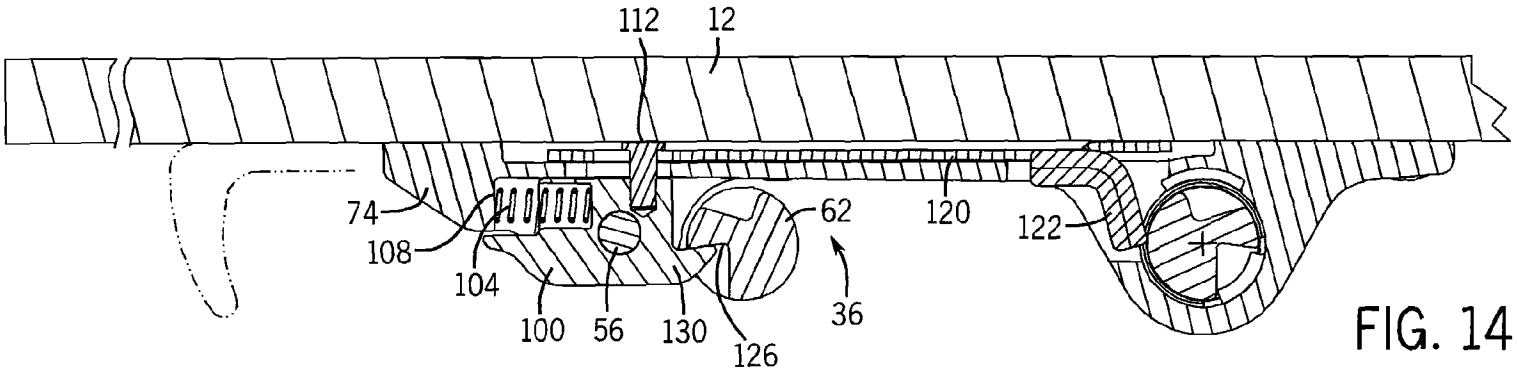
FIG. 14 is a section view taken along line 14-14 of FIG. 2.

FIGS. 12 and 14 illustrate the hinge and latch assembly 36 in its second position in which the hinge and latch assembly 36 engage the front cross-member 38 to the hold the tabletop 12 in the operative position shown in FIG. 2. In the second position, the latching finger 130 formed on the sliding front latch 100 contacts the engagement shoulder 126 formed as part of the latching collar 62. Latch spring 104 exerts a bias force on the sliding front latch 100 to maintain the condition shown in FIG. 14. When the hinge and latch assembly 36 is in the second position shown in FIG. 12, the latch pin 56 is contained near the rear end of the opening 132 formed within the latch pin bushings 94.

When an operator desires to move the tabletop from the operative position shown in FIG. 2 to the storage position shown in FIG. 5, the operator initially grasps the gripping section 70 of the pull handle 50. As shown in FIG. 2, the pull handle 50 is recessed from the front edge 32 of the tabletop 12 by distance sufficient to allow the operator easily to grasp the pull handle 50 when desired. As the user grasps the pull handle 50, the operator can pull in the direction shown by arrow 134 shown in FIG. 13. As the operator pulls in the direction by arrow 134, the pull handle 50 and the entire cross bar 48 move in the same direction as shown by arrow 136. Movement of the entire cross bar 48 results in movement of the latch pin 56 toward the front end of the opening 132 defined by the latch pin bushing 94.

Figure 13:
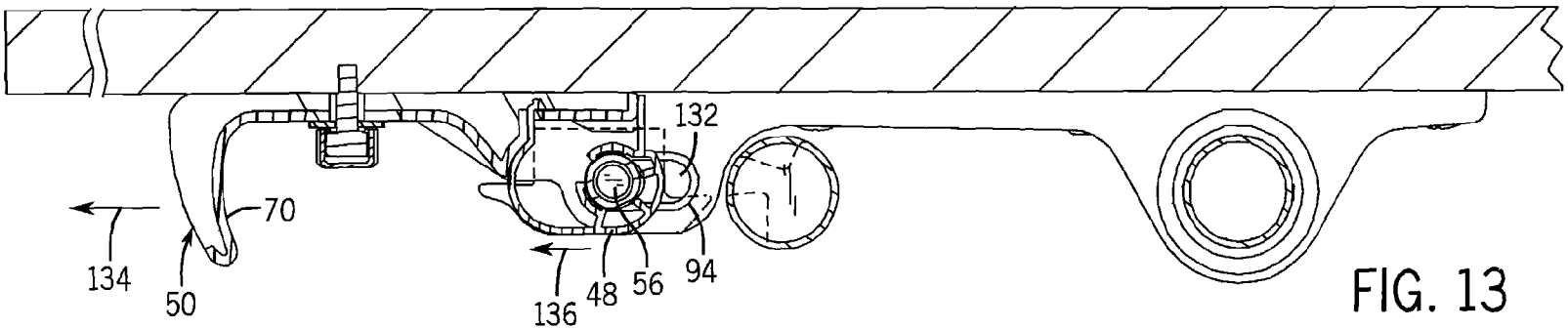
FIG. 13 is a section view similar to FIG. 12 illustrating the movement of the latch mechanism from the engaged condition of FIG. 12 to the disengaged condition of FIG. 13.
Figure 15:
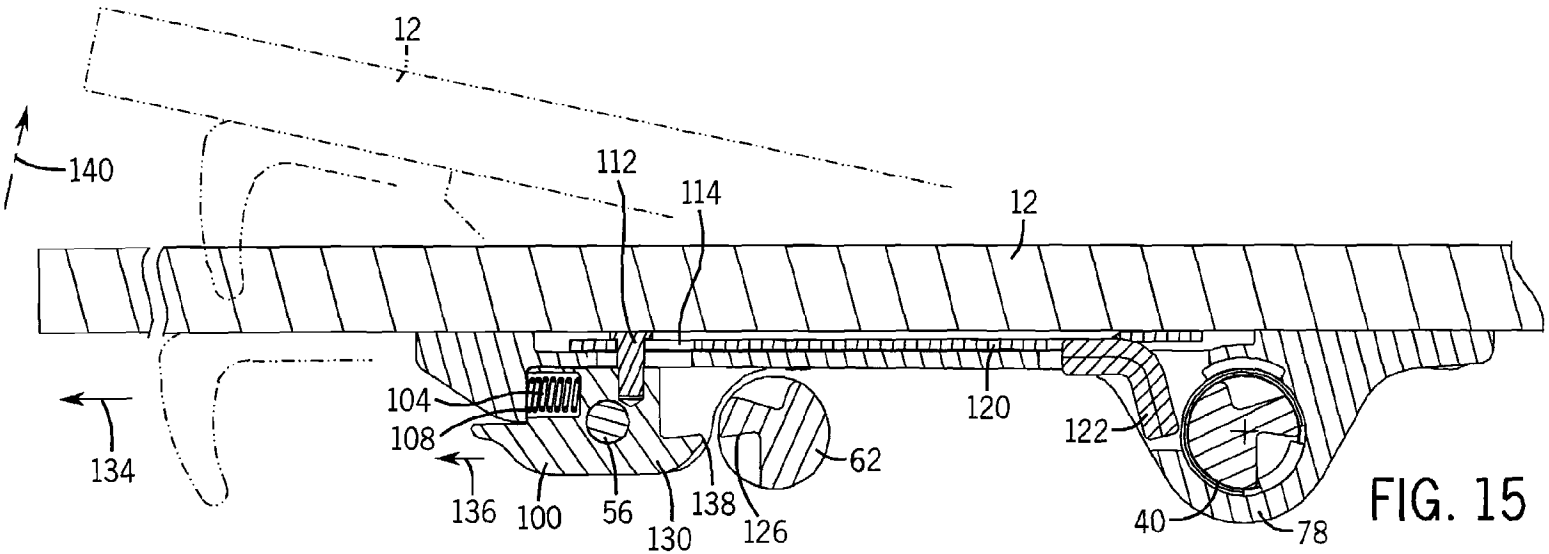
FIG. 15 is a section view similar to FIG. 14 illustrating the disengagement of the latch mechanism.

As illustrated in FIG. 15, movement of the cross bar 48 in FIG. 13 results in movement of the latch pin 56. Since the latch pin 56 is received within the sliding front latch 100, the sliding front latch 100 also moves in the direction shown by the arrow 136. The movement of the sliding front latch 100 results in the latching finger 130 moving away from and out of engagement with the engagement shoulder 126 formed on the latching collar 62. Once the outer edge 138 of the latching finger 130 clears the outermost portion of the engagement shoulder 126, the tabletop 12 is free to rotate about the rear cross member as shown by the dashed lines and arrow 140.

As can be understood in FIG. 15, when the sliding front latch 100 moves in the direction shown by arrow 136, the latch spring 104 is compressed against the end wall 108 and the connector 112 moves within the opening 114 formed in the body 120.

Once the front latch 100 has been released, the tabletop 12 and the hinge and latch assembly 36 can be pivoted relative to and about the rear cross-member 40, which is received within the hinge barrel 78.

In addition to securing the tabletop in the horizontal, operative position, the hinge and latch assembly 36 can also be utilized to secure the tabletop 12 in the generally upright, storage position shown in FIG. 5.

Figures 16, 17:
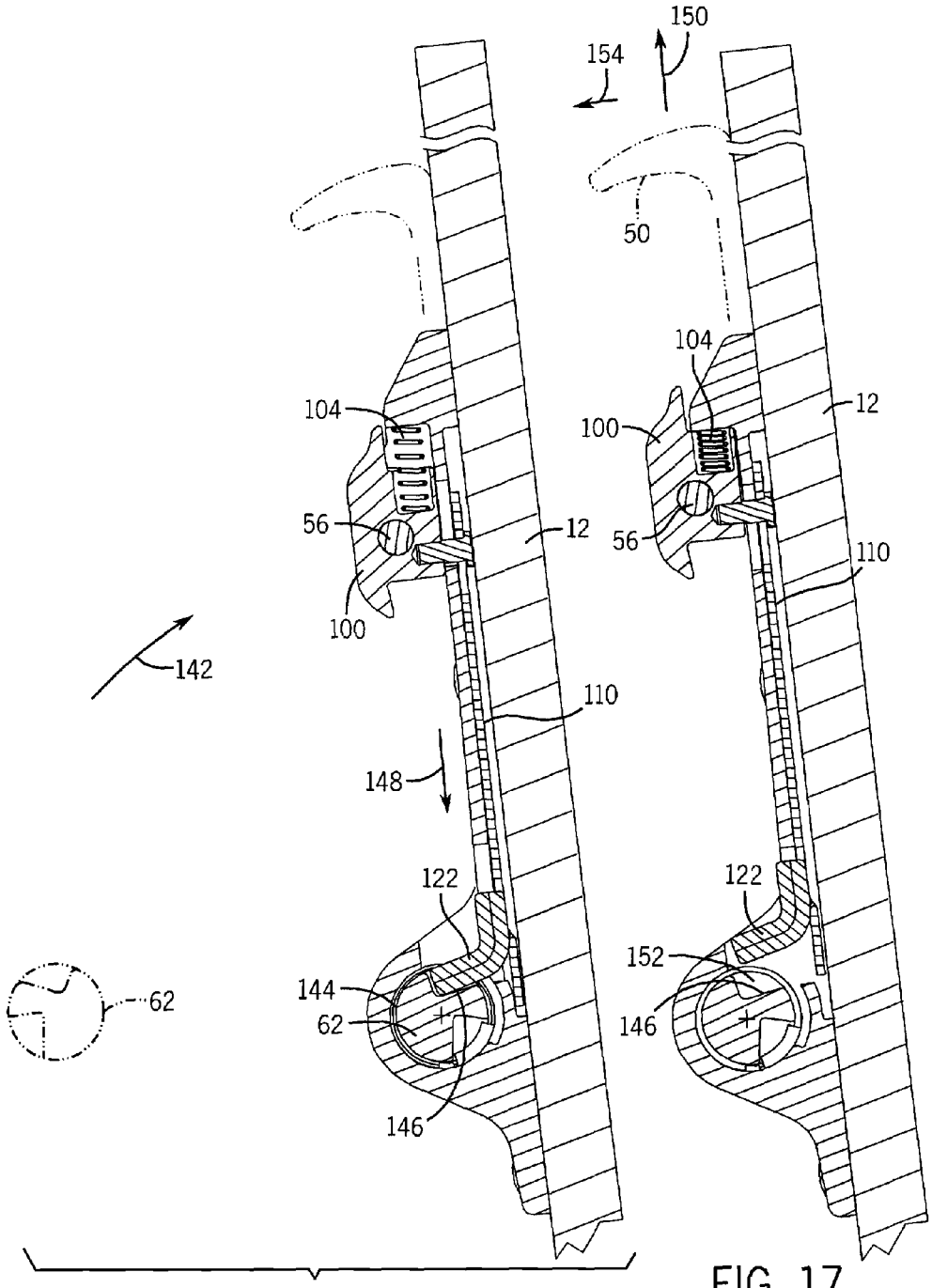
FIG. 16 is a section view taken along line 16-16 of FIG. 5.
FIG. 17 is a section view similar to FIG. 16 illustrating the disengagement of the latch mechanism to allow the tabletop to pivot between the storage and usage positions.

As the tabletop 12 continues to pivot upward in the direction shown by arrow 142 in FIG. 16, the rear latch 122 travels along the outer surface 144 of the latching collar 62 until the rear latch 122 contacts engagement shoulder 146. Once the rear latch 122 reaches the engagement shoulder 146, the force of gravity urges the entire latch member 110, including the rear latch 122, downward in the direction shown by arrow 148. In this manner, the force of gravity locks the tabletop in the upright storage position shown in FIG. 16. The weight of the tabletop 12 creates a bias force acting in a direction opposite arrow 142, which holds the rear latch 122 in the position shown. The physical contact between the rear latch 122 and the engagement shoulder 146 thus latches the tabletop 12 in the position shown in FIG. 16.

When an operator desires to release the tabletop 12 from the storage position shown in FIG. 5, the user can grasp the pull handle 50 pull the handle in the direction shown by arrow 150 in FIG. 17. As the user pulls in the direction shown by arrow 150, the cross bar engages the latch pin 56, which results in movement of the sliding front latch 100 and compression of the latch spring 104. The movement of latch pin 56 causes the entire latch member 110 to move upward against the force of gravity, thereby causing the rear latch 122 to move out of the slot 152 defined by the engagement shoulder 146. If the operator maintains the force in the direction shown by arrow 150, the operator can then pivot the entire tabletop 12 in the direction shown by arrow 154 to lower the tabletop to the operative position shown in FIG. 2.

As can be understood by the drawing figures, the hinge and latch assembly 36 of the present disclosure includes an extendable and retractable front and rear latching arrangement 100, 122 engagable and selectively lockable with the front cross member 38 and the rear cross member 40 to latch and lock the tabletop 12 in both the storage position shown in FIG. 5 and the operative position shown in FIG. 2. Further, the hinge and latch assembly 36 provides a pull handle 50 that can be easily grasped and operated by a user to engage and disengage the hinge and latch assembly 36 to move the tabletop 12 between the two positions described.

We claim:

1. A flip table assembly comprising:

a pair of spaced side supports to support the flip table assembly on a support surface;

a front cross member extending between the pair of spaced side supports;

a rear cross member spaced from the front cross member and extending between the pair of spaced side supports;

a hinge and latch assembly pivotally mounted on and about the rear cross member, the hinge and latch assembly being movable between a first position and a second position and selectively lockable with the front cross member and the rear cross member, wherein the hinge and latch assembly engages and latches to the front cross member in the second position, and engages and latches to the rear cross member in the first position; and a tabletop mounted to the hinge and latch assembly, wherein the tabletop is in a storage position when the hinge and latch assembly is in the first position and the tabletop is in an operative position when the hinge and latch assembly is in the second position.

2. The flip table assembly of claim 1 wherein the hinge and latch assembly includes at least one latch member operable to lock the hinge and latch assembly in either the first position or the second position.

3. The flip table assembly of claim 2 wherein the hinge and latch assembly includes a pull handle coupled to at least one latch member to selectively move the latch member to release the hinge and latch assembly from either the first position or the second position.

4. The flip table assembly of claim 3 wherein the pull handle is located near a front edge of the tabletop.

5. The flip table assembly of claim 1 wherein the hinge and latch assembly includes a first hinge bracket and a second hinge bracket coupled to each other by a cross bar, wherein each of the first and second hinge brackets is pivotally mounted to the rear cross member.

6. The flip table assembly of claim 5 wherein each of the hinge brackets receives a latch member, wherein each latch member is operable to lock the hinge and latch assembly in either the first position or the second position.

7. The flip table assembly of claim 6 further comprising a pull handle coupled to the cross bar to move the latch members.

8. The flip table of claim 7 wherein each of the hinge brackets is securely mounted to an underside of the table top and the pull handle is positioned adjacent the underside of the table top.

9. The flip table of claim 6 wherein each of the latch members includes a front latch and a rear latch, wherein the front latch engages the front cross member to retain the hinge and latch assembly in the second position and the rear latch engages the rear cross member to retain the hinge and latch assembly in the first position.

10. The flip table of claim 9 wherein the cross bar is selectively movable to simultaneously release both the front latch and the rear latch.

11. The flip table of claim 9 wherein each of the front legs includes an engagement shoulder and each of the rear legs include an engagement shoulder, wherein the front latches engage the engagement shoulder formed on the front legs and the rear latches engage the engagement shoulders formed on the rear legs.

12. The flip table of claim 1 wherein the pair of spaced side supports each include a front leg and a rear leg each having a ground engaging end, wherein the distance between the ground engaging ends of the front legs is less than the distance between the ground engaging ends of the rear legs.

13. The flip table of claim 12 wherein the pair of front legs are each coupled to the front cross member and the pair of rear legs are coupled to the rear cross member.

14. A hinge and latch assembly for a flip table having a tabletop supported by a pair of spaced side supports, the hinge and latch assembly comprising:

a front cross-member extending between the pair of side supports;

a rear cross-member extending between the pair of side supports;

a first hinge bracket and a second hinge bracket coupled to each other by a cross bar movable back and forth in the first hinge bracket and the second hinge bracket, wherein each of the first and second hinge brackets are pivotally mounted to the rear cross member and coupled to the tabletop; and a latch member contained within each of the first and second hinge brackets, wherein the latch members are each operable to lock the hinge and latch assembly in either a first position or a second position.

15. The hinge and latch assembly of claim 14 wherein the cross bar includes a pull handle selectively operable to move the latch members to release the hinge and latch assembly from either the first position or the second position.

16. The hinge and latch assembly of claim 15 wherein each of the latch members includes a front latch and a rear latch, wherein the front latch engages the front cross member to retain the hinge and latch assembly in the second position and the rear latch engages the rear cross member to retain the hinge and latch assembly in the first position.

17. The hinge and latch assembly of claim 16 wherein the cross bar is selectively movable to simultaneously release both of the front and rear latch members.

18. The hinge and latch assembly of claim 16 wherein the front cross member includes a pair of flat engagement shoulders each positioned to receive one of the front latches.

19. The hinge and latch assembly of claim 16 wherein the rear cross member includes a pair of flat engagement shoulders each positioned to receive one of the rear latches.

20. The hinge and latch assembly of claim 14 wherein the tabletop is in a storage position when the hinge and latch assembly is in the first position and the tabletop is in an operative position when the hinge and latch assembly is in the second position.

21. A flip table assembly comprising:

a pair of spaced side supports each having a front leg and a rear leg including a ground engaging end, wherein the distance between the ground engaging ends of the front legs is less than the distance between the ground engaging ends of the rear legs;

a front cross member extending between the pair of spaced front legs;

a rear cross member spaced from the front cross member and extending between the pair of spaced rear legs;

a hinge and latch assembly pivotally mounted on and about to the rear cross member, the hinge and latch assembly including an extendable and retractable front and rear latching arrangement selectively lockable with the front cross member and the rear cross member, and being movable between a first position to lock the table assembly in a storage position and a second position to lock the table assembly in an operative position, wherein the hinge and latch assembly engages the rear cross member in the first position and engages the front cross member in the second position; and a table top mounted to the hinge and latch assembly and movable between the storage position and the operative position.

22. The flip table of claim 21 wherein the front legs of a first flip table assembly are receivable between the rear legs of a second flip table assembly when the table top of both the first flip table assembly and the second flip table assembly are in the storage position to nest the first and second flip table assemblies.

23. The flip table assembly of claim 21 wherein the hinge and latch assembly includes a first hinge bracket and a second hinge bracket coupled to each other by a cross bar, wherein each of the first and second hinge brackets are pivotally mounted to the rear cross member.

24. The flip table assembly of claim 23 wherein each of the hinge brackets includes a latch member, wherein each latch member is operable to lock the hinge and latch assembly in either the first position or the second position.

25. The flip table assembly of claim 24 wherein each of the latch members includes a front latch and a rear latch, wherein the front latch engages the front cross member to retain the hinge and latch assembly in the second position and the rear latch engages the rear cross member to retain the hinge and latch assembly in the second position.

26. The flip table assembly of claim 25 wherein the cross bar is selectively movable to simultaneously release both the front latch and the rear latch.

* * * * *